US009044968B2

(12) United States Patent
Sanada et al.

(10) Patent No.: US 9,044,968 B2
(45) Date of Patent: Jun. 2, 2015

(54) PRINTER APPARATUS

(71) Applicant: TOSHIBA TEC KABUSHIKI KAISHA, Shinagawa-ku, Tokyo (JP)

(72) Inventors: Tsuyoshi Sanada, Susono (JP); Toshiharu Sekino, Izu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/258,229

(22) Filed: Apr. 22, 2014

(65) Prior Publication Data

US 2014/0313273 A1 Oct. 23, 2014

(30) Foreign Application Priority Data

Apr. 23, 2013 (JP) ..... 2013-090396

(51) Int. Cl.

| | |
|---|---|
| ***B41J 11/00*** | (2006.01) |
| ***B41J 3/60*** | (2006.01) |
| ***B41J 11/50*** | (2006.01) |
| ***B41J 15/18*** | (2006.01) |

(52) U.S. Cl.
CPC .. *B41J 3/60* (2013.01); *B41J 11/50* (2013.01); *B41J 15/18* (2013.01)

(58) Field of Classification Search
USPC ..... 347/211, 212–215, 217–219, 222, 171; 400/584, 611, 613, 618, 693
See application file for complete search history.

(56) References Cited

U.S. PATENT DOCUMENTS

| | | | |
|---|---|---|---|
| 8,009,183 | B2 | 8/2011 | Baba |
| 2010/0060707 | A1 | 3/2010 | Baba |

FOREIGN PATENT DOCUMENTS

| | | |
|---|---|---|
| JP | 4-17952 | 2/1992 |
| JP | 10-153888 | 6/1998 |
| JP | 2006-268430 | 10/2006 |
| JP | 2008-006680 | 1/2008 |
| JP | 2010-064272 | 3/2010 |
| JP | 2010-167578 | 8/2010 |

OTHER PUBLICATIONS

Office Action of Notification of Reason(s) for Refusal for Japanese Patent Application No. 2013-090396 Dated Mar. 10, 2015, 4 pages.

*Primary Examiner* — Kristal Feggins
(74) *Attorney, Agent, or Firm* — Amin, Turocy & Watson, LLP

(57) ABSTRACT

In accordance with one embodiment, a printer apparatus comprises a first paper conveyance path configured to convey a first paper which has printing surfaces on both sides, that is, a first surface and a second surface serving as a back surface of the first surface; a first printing section configured to carry out printing on the first surface; a second printing section configured at the downstream side of the first printing section in a paper conveyance direction to carry out printing on the second surface; and a second paper conveyance path configured to merge with the first paper conveyance path between the first printing section and the second printing section, and convey a second paper which has a printing surface on either of a first surface and a second surface serving as a back surface of the first surface.

3 Claims, 4 Drawing Sheets

PRINTER APPARATUS

CROSS-REFERENCE TO RELATED APPLICATION

This application is based upon and claims the benefit of priority from Japanese Patent Application No. 2013-090396, filed Apr. 23, 2013, the entire contents of which are incorporated herein by reference.

FIELD

Embodiments described herein relate to a printer apparatus which prints on a paper and then issues the paper.

BACKGROUND

In a printer apparatus used as an apparatus for issuing a receipt and the like, after given items are printed on long-sized paper pulled from roll-shaped paper, the printed paper is cut into a given length and then discharged.

As such a printer apparatus, a two-sided thermal printer is known which carries out printing on both sides (front side and back side) of the paper so as to decrease the consumption amount of paper.

The paper used in the two-sided thermal printer has heat-sensitive layers which generate a color when being heated on both sides (front side and back side) of the paper; however, the two-sided thermal paper serving as the paper used in the two-sided thermal printer is more expensive than the single-sided thermal paper having a heat-sensitive layer on one side only.

Therefore, it is not economically feasible to carry out printing only on one side of the two-sided thermal paper due to the high cost. However, as it takes a lot of trouble to switch and load the two-sided thermal paper and the single-sided thermal paper every time a printing job is carried out, it has been considered to load both the two-sided thermal paper and the single-sided thermal paper in one printer. It is also known how to detect the category of the paper so as not to carry out simplex printing on the two-sided thermal paper.

Even in a case where both the two-sided thermal paper and the single-sided thermal paper are loaded in one printer apparatus, when printing operation is carried out on one paper, it is necessary to retract the other paper on which printing operation is not carried out from the conveyance path, and in a case of frequently switching and using the two-sided thermal paper and the single-sided thermal paper, there exists a problem that much time is taken for the retracting processing and the printing speed of the printer is low.

DETAILED DESCRIPTION

In accordance with one embodiment, a printer apparatus comprises a first paper conveyance path configured to convey a first paper which has printing surfaces on both sides, that is, a first surface and a second surface serving as a back surface of the first surface; a first printing section configured to carry out printing on the first surface; a second printing section configured at the downstream side of the first printing section in a paper conveyance direction to carry out printing on the second surface; and a second paper conveyance path configured to merge with the first paper conveyance path between the first printing section and the second printing section, and convey a second paper which has a printing surface on either of a first surface and a second surface serving as a back surface of the first surface.

A First Embodiment

Hereinafter, the printer apparatus according to the first embodiment is described in detail with reference to the accompanying drawings.

Figure 1:
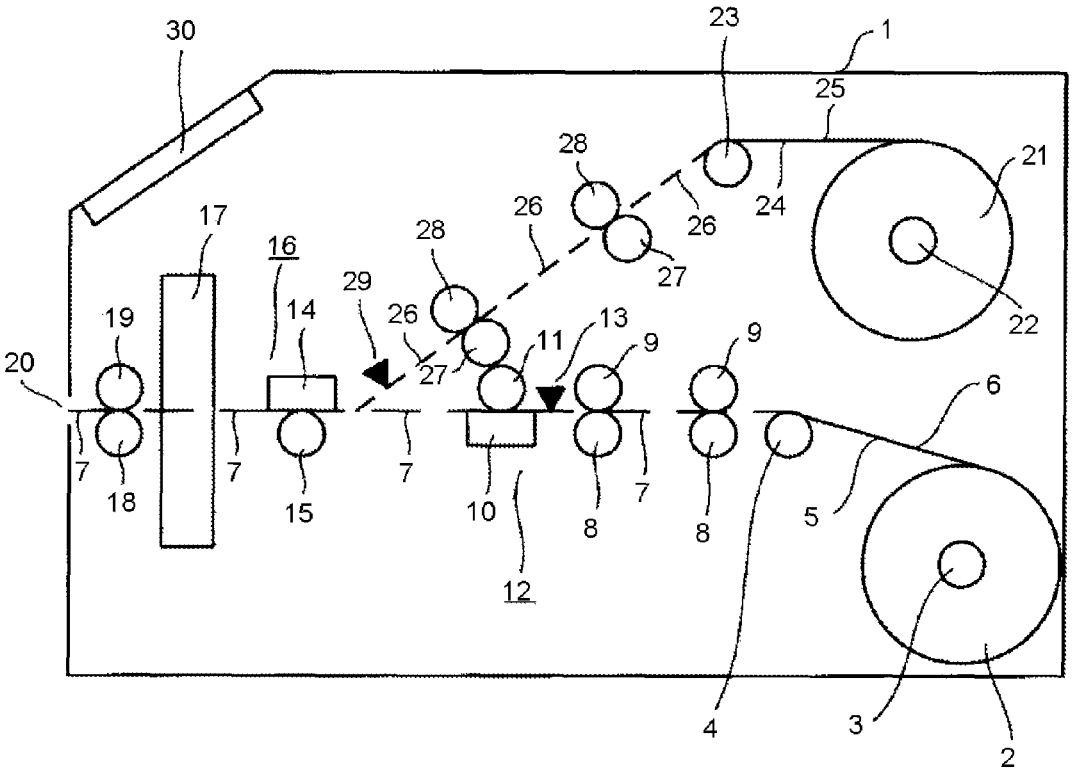
FIG. 1 is a constitution diagram illustrating main portions of a printer apparatus according to one embodiment.

FIG. 1 is a constitution diagram illustrating the main portions of the printer apparatus according to the first embodiment. In the printer, as paper is conveyed from the right side of FIG. 1 to the left side of FIG. 1, the right side of FIG. 1 is referred to as an upstream side and the left side of FIG. 1 is referred to as a downstream side in the following description.

Though there exists a case where the paper is conveyed in a direction opposite to the conveyance direction of the paper in a printing process so as to align the position of the front end of the cut paper, the upstream and the downstream sides in the present embodiment are defined as the upstream and the downstream sides in the paper conveyance direction when carrying out printing operation on the paper.

A reference numeral 2 in FIG. 1 represents roll shape paper A wound around a winding shaft A3. The winding shaft A3 is rotatably supported on a frame (not shown) of a printer apparatus 1 to load paper A2 in the printer apparatus 1. The paper A2 has a paper surface A5 and a paper surface B6 serving as a surface opposite to the paper surface A5, both of which include a heat-sensitive layer which generates a color when being heated.

An idler roller A4 is rotatably supported at the downstream side of the paper A2.

A paper discharge port 20 for discharging the printed paper to the outside of the printer apparatus 1 and a paper conveyance path A7 for conveying the paper from the idler roller A4 to the paper discharge port 20 are arranged in the printer apparatus 1.

At the downstream side of the idler roller A4, a plurality of feed rollers A8 which can be rotated by a motor (not shown) are arranged, and a plurality of idler rollers B9 are arranged opposite to the feed rollers A8 across the paper conveyance path A7.

Further, a first thermal print head 10 and a first platen roller 11 which can be rotated by a motor (not shown) are arranged opposite to each other across the paper conveyance path A7 at the downstream side of the idler roller A4. The first thermal print head 10 and the first platen roller 11 constitute a first printing section 12 which carries out printing operation on the paper surface A5 of the paper A2.

A second thermal print head 14 and a second platen roller 15 which can be rotated by a motor (not shown) are arranged opposite to each other across the paper conveyance path A7 at the downstream side of the first printing section 12. The second thermal print head 14 and the second platen roller 15 constitute a second printing section 16 which carries out printing operation on the paper surface B6 of the paper A2.

A cutter 17 is arranged at the downstream side of the second printing section 16. The cutter 17 comprises a fixed blade (not shown) and a movable blade (not shown). The paper A2 and a paper B21 which will be described later inserted in a slit (not shown) arranged in the cutter 17 are cut by sliding and moving the movable blade towards the fixed blade through the driving of a cutter motor (not shown).

The cutter 17 is described herein as a so called slide type cutter which slides the movable blade towards the fixed blade, however, the present invention is not limited to this. The cutter may also be a so called rotary type cutter which cuts paper by rotating the movable blade towards the fixed blade.

At the downstream side of the cutter 17, a feed roller C18 which can be rotated by a motor (not shown) and an idler roller C19 are arranged opposite to each other across the paper conveyance path A7. Further, the printer apparatus 1 is provided with the paper discharge port 20 at the downstream side of the feed roller C18. The printed paper A2 and the printed paper B21 (described later) cut by the cutter 17 are discharged to the outside of the printer apparatus 1 through the paper discharge port 20.

In addition, wound roll shape paper B21 different from the paper A2 can be loaded in the printer apparatus 1.

The paper B21 is roll shape paper wound around a winding shaft B22 which is rotatably supported in the printer apparatus 1. The winding shaft B22 is rotatably supported on a frame (not shown) of the printer apparatus 1 to load paper B21 in the printer apparatus 1. The paper B21 is loaded in the printer apparatus 1 at a position above the paper A2.

The paper B21 has a paper surface C24 and a paper surface D25 serving as a surface opposite to the paper surface C24, and a heat-sensitive layer which generates a color when being heated is arranged only at the side of the paper surface D25.

An idler roller D23 is rotatably supported at the downstream side of the paper B21.

A paper conveyance path B26, which extends to connect the idler roller D23 with the paper conveyance path A7 between the first printing section 12 and the second printing section 16, is arranged to convey the paper B21, and the paper conveyance path B26 merges with the paper conveyance path A7 at a position between the first printing section 12 and the second printing section 16.

At the downstream side of the idler roller D23, a plurality of feed rollers B27 which can be rotated by a motor (not shown) are arranged, and a plurality of idler rollers D28 are arranged opposite to the feed rollers B27 across the paper conveyance path B26.

A paper sensor A13 is arranged on the paper conveyance path A7 nearby the upstream side of the first printing section 12, and a paper sensor B29 is arranged on the paper conveyance path B26 nearby the upstream side of the second printing section 16. The paper sensor A13 and the paper sensor B29 are used so as to determine the heating timing of the first thermal print head 10 and the second thermal print head 14 according to detection signals obtained by detecting the front ends of the paper A2 and the paper B21, and confirm, when carrying out printing operation on one paper, whether or not the other paper is retracted from the shared paper conveyance path so as to prevent that the paper A2 and the paper 321 are inserted into the shared paper conveyance path simultaneously.

A display section 30 is arranged in the printer apparatus 1 to display various states of the printer apparatus 1 including an error situation.

Figure 2:
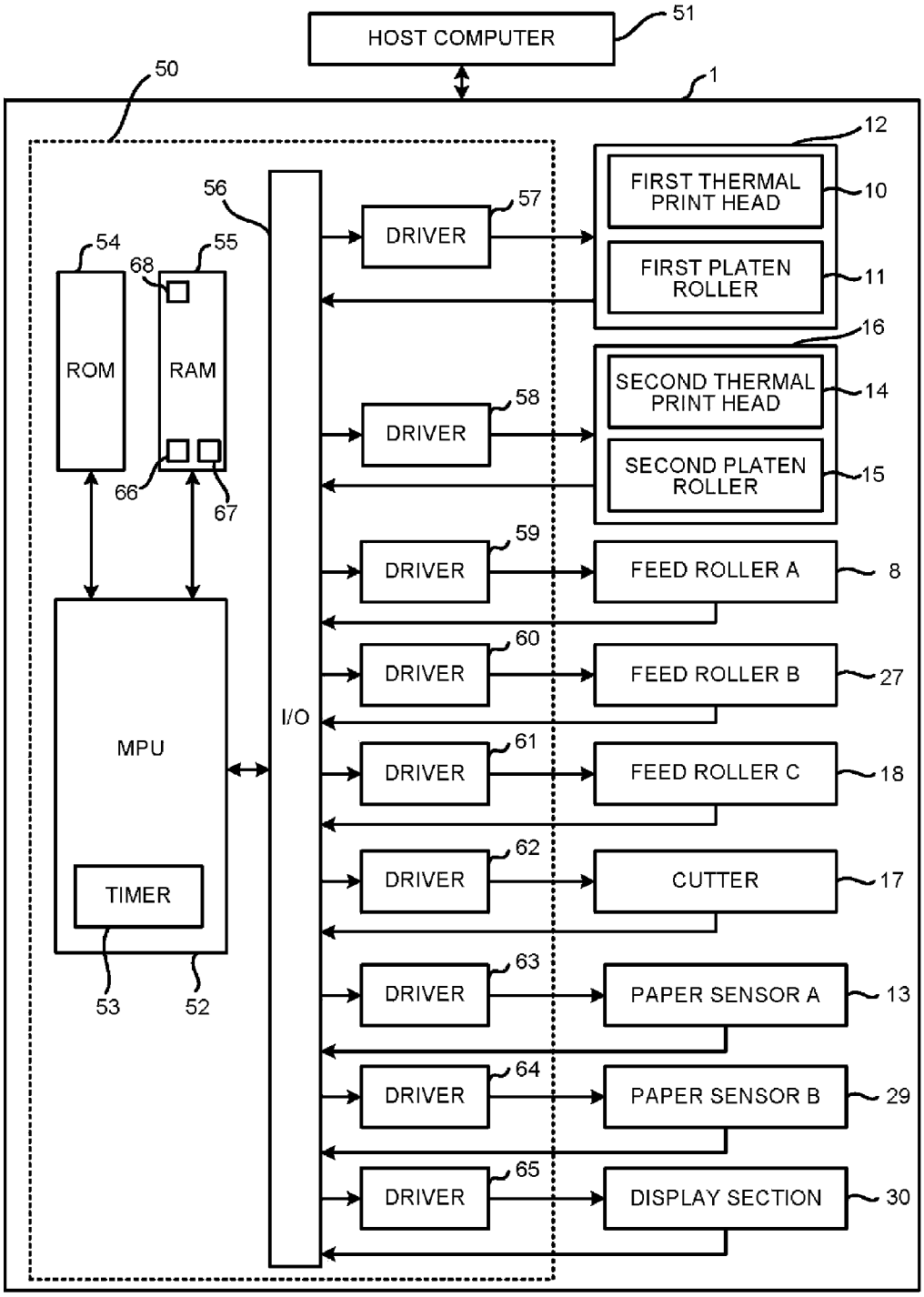
FIG. 2 is a control block diagram of the printer apparatus according to the present embodiment.

FIG. 2 is a block diagram illustrating the constitution of the control circuit of the printer apparatus 1 according to the present embodiment. A control section 50 controls the paper conveyance, printing, paper cutting, paper discharging and the display of the condition of the printer.

The control section 50 is formed by, for example, a microcomputer which associates with a host computer 51 and carries out various controls. A micro processing unit (MPU) 52 of the control section 50 carries out, according to a program, various controls such as a paper conveyance control, a printing control, a paper cutting control and a paper discharging control, and operations.

Further, the MPU 52 comprises a timer 53 serving as a module for setting and controlling time.

Further, a ROM 54 and a RAM 55 are arranged in the control section 50 as primary storage modules for storing the control programs executed by the MPU 52 and the data generated during a control or operation process.

The ROM 54 is a read-only memory in which control programs and tables are stored, and the RAM 55 is a random access memory for storing the data generated during an operation process.

When carrying out printing on the paper A2, the printing data from the host computer 51 are divided into the data to be printed on the paper surface A5 and the data to be printed on the paper surface B6, and a data storage section 66 for paper surface A and a data storage section 67 for paper surface B are arranged in the RAM 55 to respectively store the data to be printed on the paper surface A5 and the data to be printed on the paper surface B6. Similarly, a data storage section 68 for paper surface D is arranged in the RAM 55 to store the printing data from the host computer 51 when carrying out printing on the paper B21.

Further, an input/output unit (I/O) 56 is arranged in the control section 50 to read various input data from the host computer 51 and extract a control output of the control section 50 to the host computer 51. The I/O 56 is connected with the MPU 52, the ROM 54 and the RAM 55 via a bus line.

The I/O 56 is connected with a first, a second, a third, a fourth, a fifth, a sixth, a seventh, an eighth and a ninth drivers 57, 58, 59, 60, 61, 62, 63, 64 and 65 serving as modules for extracting a control output.

The first driver 57 supplies a required drive output for the first printing section 12. The second driver 58 supplies a required drive output for the second printing section 16. The third driver 59 supplies a drive output for the feed roller A8. The fourth driver 60 supplies a drive output for the feed roller B27. The fifth driver 61 supplies a drive output for the feed roller C18. The sixth driver 62 supplies a drive output for the cutter 17. The seventh driver 63 supplies a drive signal for the paper sensor A13. The eighth driver 64 supplies a drive signal for the paper sensor B29. The ninth driver 65 supplies a display drive output for the display section 30 to enable the display section 30 to execute various displays.

When carrying out printing on the paper A2 using the first printing section 12 and the second printing section 16, the first platen roller 11 is rotationally driven by a motor in synchronization with the printing operation based on a control output serving as a printing instruction module of the MPU 52. The first thermal print head 10 carries out printing on the paper surface A5 of the paper A2 based on the data for the paper surface A which is created in the MPU 52 based on the printing data from the host computer 51 and then stored in the data storage section for paper surface A. The second platen roller 15 is rotationally driven by a motor (not shown) in synchronization with the printing operation based on a control output serving as a printing instruction module of the MPU 52. The second thermal print head 14 carries out printing on the paper surface B6 of the paper A2 based on the printing data for the paper surface B which is created in the MPU 52 and then stored in the data storage section 67 for paper surface B.

When carrying out printing on the paper B21, the second platen roller 15 is rotationally driven by a motor in synchronization with the printing operation based on a control output serving as a printing instruction module of the MPU 52. The second thermal print head 14 carries out printing on the paper surface D25 of the paper B21 based on the printing data for the paper surface D which is created in the MPU 52 and then stored in the data storage section 68 for paper surface D.

The MPU 52 of the control section 50 rotates the feed roller A8 and stops the rotation of the feed roller A8 with the driver 59.

The MPU 52 of the control section 50 rotates the feed roller 327 and stops the rotation of the feed roller B27 with the driver 60.

The MPU 52 of the control section 50 rotates the feed roller C18 and stops the rotation of the feed roller C18 with the driver 61.

The MPU 52 of the control section 50 drives the cutter 17 with the driver 62 to cut the paper A2 or the paper B21.

The MPU 52 of the control section 50 drives the paper sensor A13 with the driver 63 and receives a detection signal of the paper sensor A13.

The MPU 52 of the control section 50 drives the paper sensor B29 with the driver 64 and receives a detection signal of the paper sensor B29.

The MPU 52 of the control section 50 displays various information and errors and the like of the printer apparatus 1 on the display section 30 under the drive of the driver 65.

Figure 3:
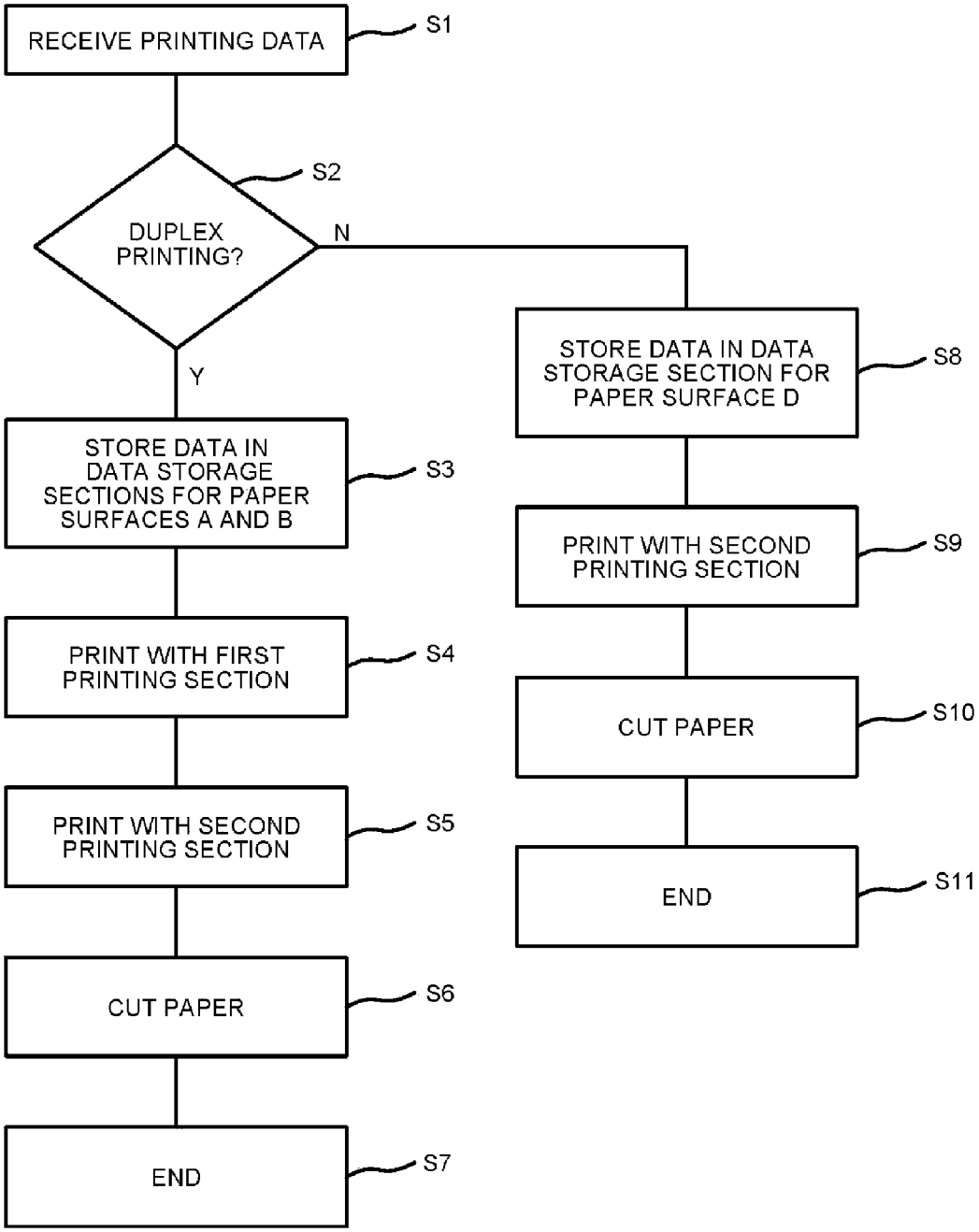
FIG. 3 is a flowchart illustrating a printing method of the printer apparatus according to the present embodiment.

The operations of the printer apparatus 1 are described below with reference to FIG. 1 and FIG. 3. The control section carries out paper conveyance and printing operation according to the programs stored in the ROM 54.

First, a user pulls out the paper A2 and positions the front end of the paper A2 between the feed roller A8 and the idler roller B9 via the idler roller A4. Then the user pulls out the paper B21 and positions the front end of the paper B21 between the feed roller B27 and the idler roller D28 via the idler roller D23.

In this state, if the printing data form the host computer 51 is received (ACT S1), the control section 50 determines whether or not the received printing data is duplex printing data to be printed on both sides of the paper (ACT S2). If it is determined that the received data is duplex printing data (YES in ACT S2), the control section 50 divides the received printing data into the data to be printed on the paper surface A5 and the data to be printed on the paper surface B6, and then stores the divided data in the data storage section 66 for paper surface A and the data storage section 67 for paper surface B, respectively (ACT S3).

The control section 50 drives the first printing section 12 to print the printing data stored in the data storage section 66 for paper surface A on the paper surface A5 of the paper A2 through the cooperation of the first thermal print head 10 and the first platen roller 11 (ACT S4).

Then, the control section 50 drives the second printing section 16 to print the printing data stored in the data storage section 67 for paper surface B on the paper surface B6 of the paper A2 through the cooperation of the second thermal print head 14 and the second platen roller 15 (ACT S5).

In addition, it is exemplified in the present embodiment that the second printing section 16 is driven after the first printing section 12 is driven. However, the present invention is not limited to this; the second printing section 16 is not necessarily to be driven after the first printing section 12 is driven. For example, there exists a case where the printing on the paper surface B6 of the paper A2 is carried out in synchronization with the printing on the paper surface A5 of the paper A2. Further, there also exists a case where the second printing section 16 is driven before the first printing section 12 is driven when there is blank space at the front end side of the paper surface A5, even in a case of printing on both sides (paper surface A5 and paper surface B6) of the paper A2.

When the printing on the paper A2 by the first printing section 12 and the second printing section 16 is completed, the paper A2 is further conveyed to the downstream side, and then cut by the cutter 17 (ACT S6). Then the printed paper A2 is discharged to the outside of the printer apparatus 1 through the paper discharge port 20 under the cooperation of the feed roller C18 and the idler roller C19, and then the printing operation is ended (ACT S7).

If it is determined that the printing data received from the host computer 51 is not the duplex printing data (NO in ACT S2), the control section 50 stores the received printing data in the data storage section 68 for paper surface D of the RAM 55 (ACT S8).

Then the control section 50 drives the second printing section 16 to print the printing data stored in the data storage section 68 for paper surface D on the paper surface D25 through the cooperation of the second thermal print head 14 and the second platen roller 15 (ACT S9).

When the printing on the paper B21 by the second printing section 16 is completed, the paper B21 is further conveyed to the downstream side, and then cut by the cutter 17 (ACT S10). Then the printed paper B21 is discharged to the outside of the printer apparatus 1 through the paper discharge port 20 under the cooperation of the feed roller C18 and the idler roller C19, and then the printing operation is ended (ACT S11).

When printing operation is carried out by the printer apparatus 1, there is a case where the paper A2 and the paper B21 are switched frequently to output printing. The printer apparatus 1 does not carry out printing operation during the switching process, therefore, the shortening of the switching time contributes to the speeding up of the printer apparatus 1.

Figure 4:
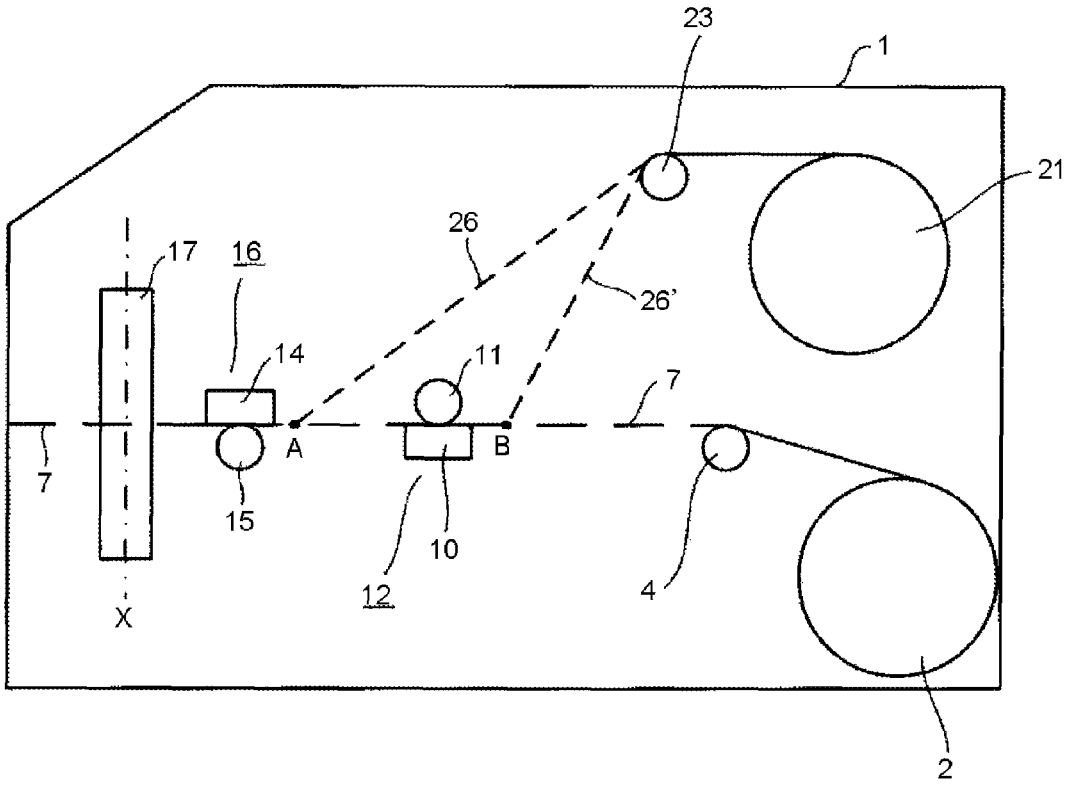
FIG. 4 is a structure diagram illustrating paper mergence positions of the printer apparatus according to the present embodiment and a conventional printer apparatus.

FIG. 4 is a diagram illustrating the position relation of the paper conveyance path A7, the first printing section 12, the second printing section 16 and the paper conveyance path B26 in the present embodiment. The description of the feed roller and the idler roller is omitted in FIG. 4. And for the sake of the comparison with the conventional conveyance path, the conventional conveyance path B is endowed with a reference numeral "26'".

A line X in FIG. 4 indicates a cutting position of the paper A2 or the paper B21 by the cutter 17. A point A indicates a position where the paper conveyance path B26 merges with the paper conveyance path A7 in the present embodiment, and the point A is positioned between the first printing section 12 and the second printing section 16. A point B indicates a position where the conveyance path B26' merges with the paper conveyance path A7 in the conventional apparatus, and the point B is positioned at the upstream side of the first printing section 12, but not between the first printing section 12 and the second printing section 16.

A case of switching from the paper A2 to the paper B21 is described herein. In the present embodiment, the downstream side of the point A is the shared conveyance path for the printing on the paper A2 and the printing on the paper B21. Since the path is the shared conveyance path, when printing operation is carried out on one paper, it is necessary to retract the other paper on which the printing is not carried out from the shared paper conveyance path.

In the present embodiment, after given items are printed, in order to switch the paper A2 cut by the cutter 17 to the paper B21, the front end of the paper A2 have to be positioned at the upstream side of the point A. Therefore, it is necessary to convey the paper A2 from the line X to the point A in an opposite direction, and then the paper B21 is conveyed to the shared conveyance path.

In the conventional apparatus, the front end of the paper A2 have to be positioned at the upstream side of the point B. Thus, it is necessary to convey the paper A2 from the line X to the point B in an opposite direction, and then the paper B21 is conveyed to the shared conveyance path.

As to the distance for which the paper A2 needs to be conveyed in an opposite direction for the switching, the distance in the present embodiment is from the line X to the point A, while the distance in the conventional apparatus is from the line X to the point B. As state above, in the conventional apparatus, the switching processing cannot be carried out unless the paper A2 is further conveyed in an opposite direction for a distance from the point A to the point B. The time taken for the switching processing becomes longer as the distance is long, as a result, the time taken for the printing operation of the printer apparatus 1 becomes longer.

In a case of switching from the paper B21 to the paper A2, in the conventional apparatus, the switching processing cannot be carried out unless the paper B21 is further conveyed in an opposite direction for a distance from the point A to the point B.

As stated above, in the printer apparatus 1 which switches and uses the paper A2 having heat-sensitive layers on both sides and the paper B21 having the heat-sensitive layer on one side only, the time taken for the switching processing of the printer apparatus 1 can be shortened by merging the paper conveyance path B26 of the paper B21 with the paper conveyance path A7 of the paper A2 between the first printing section 12 and the second printing section 16.

A Second Embodiment

Hereinafter, the printer apparatus 1 according to the second embodiment is described in detail with reference to the accompanying drawings. Components the same with those in the first embodiment are endowed with the same reference numerals, and therefore, the detailed descriptions thereof are not repeated.

In the second embodiment, in the first printing section 12 and the second printing section 16 in the printer apparatus 1, the paper conveyance speed of the second printing section 16 is set to be faster than the paper conveyance speed of the first printing section 12.

As to motors used in the printer apparatus 1, inmost cases, a motor having a fast rotation speed is more expensive than a motor having a slow speed. If all motors used in the printer apparatus 1 are changed to motors having a fast rotation speed so as to realize the speeding up of the printer apparatus 1, the printing speed of the printer apparatus 1 can be improved, however, the cost of the printer apparatus is also increased. Therefore, if the speed of the printer apparatus 1 can be improved by changing part of the motors, instead of changing all the motors, to motors having a fast rotation speed, it is preferred to change part of the motors only.

As described in the first embodiment, in a case of switching from the paper A2 to the paper B21, the reverse conveyance distance of the paper A2 for the paper switching in the first embodiment in which the conveyance path of the paper B21 merges with the conveyance path of the paper A2 between the first printing section 12 and the second printing section 16 is the distance from the line X to the point A shown in FIG. 4. Further, in the conventional apparatus where the paper conveyance path B26' of the paper B21 merges with the conveyance path of the paper A2 at the upstream side of the first printing section 12, the reverse conveyance distance of the paper A2 for the paper switching is the distance from the line X to the point B shown in FIG. 4. Therefore, in the conventional apparatus where the paper conveyance path B26' of the paper B21 merges with the conveyance path of the paper A2 at the upstream side of the first printing section 12, the switching processing cannot be carried out unless the paper A2 is further conveyed in an opposite direction for a distance from the point A to the point B.

Herein, in a case where the motor of the second printing section 16 is changed to make the speed of the second printing section 16 faster than that of the first printing section 12, the reverse conveyance for a distance from the line X to the point A can be carried out faster. However, in the conventional apparatus where the paper conveyance path B26' of the paper B21 merges with the conveyance path of the paper A2 at the upstream side of the first printing section 12, the reverse conveyance distance of the paper A2 for the paper switching is the distance from the line X to the point B, and the speed of the first printing section 12 cannot be improved even though the speed of the second printing section 16 is improved. As a result, the paper between the second printing section 16 and the first printing section 12 slackens, which may lead to a problem such as paper jam. Therefore, it is necessary to improve the speed of the first printing section 12 so as to prevent such a problem, which leads to a high cost of the printer apparatus 1 as stated above.

Compared with a case where the paper conveyance path 326' of the paper B21 merges with the paper conveyance path A7 of the paper A2 at the upstream side of the first printing section 12, in the case where the paper conveyance path B26 of the paper B21 merges with the paper conveyance path A7 of the paper A2 between the first printing section 12 which carries out printing on the paper surface A5 and the second printing section 16 which carries out printing on the paper surface B6 as stated above, it is possible to improve the speed of the printer apparatus 1 by only improving the speed of the second printing section 16, therefore, with the printing time taken into consideration, the position relation in the present embodiment is much more preferred than that in the conventional case.

When carrying out printing on the paper B21 serving as wound roll shape paper, the time taken for printing and the time taken for the reverse conveyance for paper switching after the printing can be shortened if the speed of the second printing section 16 is improved. In a case where the paper to be printed is not the roll shape paper, but a cut paper, the difference is much more apparent in a case where the paper conveyance path of the single-sided paper merges with the paper conveyance path of the two-sided paper between the first printing section 12 and the second printing section 16 which carry out printing on the paper.

In the first embodiment and the second embodiment, the paper B21 is loaded above the paper A2.

In most cases, a cover (not shown) of the printer apparatus 1 is opened upwards to load paper in the printer apparatus 1. In a case where a plurality of kinds of papers are loaded in a vertical direction, if the paper holding sections are not shifted back and forth in the paper conveyance direction, the lower paper cannot be loaded without taking out the upper paper. However, if the paper holding sections are shifted back and forth in the paper conveyance direction, the size of the printer apparatus 1 is increased. Thus, in a case where the paper holding sections are not shifted back and forth in the paper conveyance direction, it is necessary to load the paper which needs to be exchanged frequently or the paper which is used frequently and therefore needs to be reloaded frequently at the upper position.

In most cases, the printer apparatus 1 is used as a printer for outputting a receipt when purchasing a commodity. When outputting a receipt, there are a case where the printing is carried out on both surfaces of the paper so as to shorten the length of the receipt, and a case where the back surface of the receipt is used to print an advertisement or a discount coupon.

In a case of using the back surface of the paper as an advertisement or a discount coupon, as the cost of the paper having heat-sensitive layers on both surfaces is high, the single-sided thermal paper on the back surface of which an advertisement or a discount coupon is printed in advance is widely used.

As most of the advertisements and the discount coupons have an expiration date, the single-sided thermal paper on the back surface of which the advertisement or the discount coupon is printed in advance has to be exchanged if the paper is not used up as receipt before the expiration date. However, as to the paper having heat-sensitive layers on both surfaces thereof, it only needs to change the back surface printing data from the host computer 51 even in a case of printing an advertisement or a discount coupon on the back surface, and the paper needs not to be exchanged despite of the remaining paper. At this point, the exchange frequency of the single-sided paper is higher than that of the two-sided paper. Therefore, as to the paper loading, it is important to arrange the holding section of the single-sided paper above the holding section of the two-sided paper.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer apparatus, comprising:

a first conveyance section configured to convey a first paper which has printing on a first surface and a second surface facing the first surface;

a first printing section configured to carry out printing on the first surface;

a second printing section configured at the downstream side of the first printing section in a paper conveyance direction to carry out printing on the second surface;

a second conveyance section configured to merge with the first paper conveyance section between the first printing section and the second printing section, and convey a second paper which has a printing surface on either of a first surface or a second surface facing the first surface;

a shared conveyance section arranged at the downstream side of a mergence position of the first conveyance section and the second conveyance section in the paper conveyance direction, and configured to convey the first paper or the second paper; and a control section configured to control the first conveyance section and the second conveyance section, wherein when printing on the first paper is carried out, the second paper is to be retracted, and when printing on the second paper is carried out, the first paper is to be retracted.

2. The printer apparatus according to claim 1, wherein a conveyance speed of the first paper in the second printing section is faster than that of the second paper in the first printing section.

3. The printer apparatus according to claim 1, wherein a loading position of the second paper supplied for the second paper conveyance section is above a loading position of the first paper supplied for the first paper conveyance section in the printer apparatus.

* * * * *